US012729894B2

(12) United States Patent
Morie

(10) Patent No.: US 12,729,894 B2
(45) Date of Patent: Sep. 8, 2026

(54) CRYOCOOLER AND MONITORING METHOD FOR CRYOCOOLER

(71) Applicant: SUMITOMO HEAVY INDUSTRIES, LTD., Tokyo (JP)

(72) Inventor: Takaaki Morie, Yokosuka (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 651 days.

(21) Appl. No.: 18/123,347

(22) Filed: Mar. 20, 2023

(65) Prior Publication Data

US 2023/0228472 A1 Jul. 20, 2023

Related U.S. Application Data

(63) Continuation of application No. PCT/JP2021/032255, filed on Sep. 2, 2021.

(30) Foreign Application Priority Data

Sep. 25, 2020 (JP) ..... 2020-160484

(51) Int. Cl.
*F25B 49/02* (2006.01)
*F25B 9/14* (2006.01)

(52) U.S. Cl.
CPC ..... *F25B 49/02* (2013.01); *F25B 9/145* (2013.01); *F25B 2309/1427* (2013.01); *F25B 2700/15* (2013.01)

(58) Field of Classification Search
CPC .... F25B 9/06; F25B 9/145; F25B 9/10; F25B 9/14; F25B 49/02; F25B 49/005; F25B 2500/26; F25B 2700/15; F25B 2700/151; F25B 2600/0253
See application file for complete search history.

(56) References Cited

U.S. PATENT DOCUMENTS

| | | | | |
|---|---|---|---|---|
| 5,651,667 | A | 7/1997 | Sand et al. | |
| 8,794,016 | B2 | 8/2014 | Ogden et al. | |
| 10,174,974 | B2 | 1/2019 | Nakashima | |
| 10,184,694 | B2 | 1/2019 | Morie | |
| 2003/0197991 | A1* | 10/2003 | Kahlon | H02J 1/08 361/90 |
| 2015/0280619 | A1* | 10/2015 | Marohl | H02P 27/085 318/400.17 |

(Continued)

FOREIGN PATENT DOCUMENTS

| | | | |
|---|---|---|---|
| CN | 104930761 | A | 9/2015 |
| CN | 108627711 | A | 10/2018 |

(Continued)

*Primary Examiner* — Frantz F Jules
*Assistant Examiner* — Webeshet Mengesha
(74) *Attorney, Agent, or Firm* — HEA Law PLLC

(57) ABSTRACT

The cryocooler includes an expander motor that operates an expander of the cryocooler, an inverter that is configured to control an operation frequency of the expander motor and is operable to drive the expander motor in the steady operation at an operation frequency lower than in the cool-down operation, a current sensor that measures a current supplied from the inverter to the expander motor, and outputs a motor current signal indicating the current; and a processor that monitors the expander motor on a basis of the motor current signal in at least the steady operation.

7 Claims, 7 Drawing Sheets

(56) References Cited

U.S. PATENT DOCUMENTS

| | | | | |
|---|---|---|---|---|
| 2017/0276128 | A1* | 9/2017 | Takahashi | F04B 37/085 |
| 2022/0235984 | A1 | 7/2022 | Morie | |

FOREIGN PATENT DOCUMENTS

| | | | |
|---|---|---|---|
| JP | H03152353 | A | 6/1991 |
| JP | H05280467 | A | 10/1993 |
| JP | H09140151 | A | 5/1997 |
| JP | 2722731 | B2 | 3/1998 |
| JP | 2002238278 | A | 8/2002 |
| JP | 2008101860 | A | 5/2008 |
| JP | 2008202905 | A | 9/2008 |
| JP | 2012159270 | A | 8/2012 |
| JP | 2016052225 | A | 4/2016 |
| JP | 2016211780 | A | 12/2016 |
| WO | 2018073855 | A1 | 4/2018 |
| WO | 2021075274 | A1 | 4/2021 |

* cited by examiner

62

CRYOCOOLER AND MONITORING METHOD FOR CRYOCOOLER

RELATED APPLICATIONS

The contents of Japanese Patent Application No. 2020-160484, and of International Patent Application No. PCT/JP2021/032255, on the basis of each of which priority benefits are claimed in an accompanying application data sheet, are in their entirety incorporated herein by reference.

BACKGROUND

Technical Field

Certain embodiments of the present invention relate to a cryocooler and a monitoring method for the cryocooler.

Description of Related Art

In the related art, it has been known that a rotation speed of a drive motor of an expander is increased by an inverter in order to reduce a cooling drop time when the cryocooler is started. In this starting operation, in a case where an abnormal variation is detected in a motor current, a motor rotation speed is reduced and the drive motor is protected.

SUMMARY

According to an aspect of the present invention, there is provided a cryocooler capable of executing a steady operation and a cool-down operation prior to the steady operation. The cryocooler includes an expander motor that operates an expander of the cryocooler; an inverter that is configured to control an operation frequency of the expander motor and is operable to drive the expander motor in the steady operation at an operation frequency lower than in the cool-down operation; a current sensor that measures a current supplied from the inverter to the expander motor, and outputs a motor current signal indicating the current; and a processor that monitors the expander motor on a basis of the motor current signal in at least the steady operation.

According to another aspect of the present invention, there is provided a monitoring method for a cryocooler. The cryocooler is capable of executing a steady operation and a cool-down operation prior to the steady operation, and includes an expander motor that operates an expander of the cryocooler and an inverter that is configured to control an operation frequency of the expander motor and is operable to drive the expander motor in the steady operation at an operation frequency lower than in the cool-down operation. The monitoring method includes measuring a current supplied from the inverter to the expander motor; and monitoring the expander motor on a basis of the current of the expander motor in at least the steady operation.

According to still another aspect of the present invention, there is provided a cryocooler including an expander motor that operates an expander of the cryocooler; an inverter that is configured to control an operation frequency of the expander motor; and a processor that monitors the expander motor on a basis of a power consumption signal indicating power consumption of the inverter or the expander motor.

According to still another aspect of the present invention, there is provided a monitoring method for a cryocooler. The cryocooler includes an expander motor that operates an expander of the cryocooler and an inverter that is configured to control an operation frequency of the expander motor. The monitoring method includes acquiring power consumption of the inverter or the expander motor; and monitoring the expander motor on a basis of the acquired power consumption.

DETAILED DESCRIPTION

As a cryocooler is operated for a long period of time, a load applied to a drive motor of an expander tends to gradually increase. A load that exceeds the specification limit of the motor causes an abnormal operation or a failure such as step-out of the motor, which causes abnormal noise in the cryocooler or hinders a normal operation of the cryocooler.

It is desirable to provide a cryocooler and a monitoring method therefor that are useful for predicting or preventing an abnormal operation or a failure of an expander motor due to long-term operation.

Any combination of the constituents described above and a combination obtained by replacing the constituents and expressions of the present invention between methods, devices, and systems are also effective as an aspect of the present invention.

Hereinafter, an embodiment for carrying out the present invention will be described in detail with reference to the drawings. In the description and drawings, the same or equivalent constituents, members, and processes will be given the same reference signs, and redundant description thereof will be omitted as appropriate. The scales or shapes of shown constituents are set for convenience in order to make the description easy to understand, and are not to be understood as limiting unless stated otherwise. The embodiment is merely an example and does not limit the scope of the present invention. All characteristics and combinations to be described in the embodiment are not necessarily essential to the invention.

Figure 1:
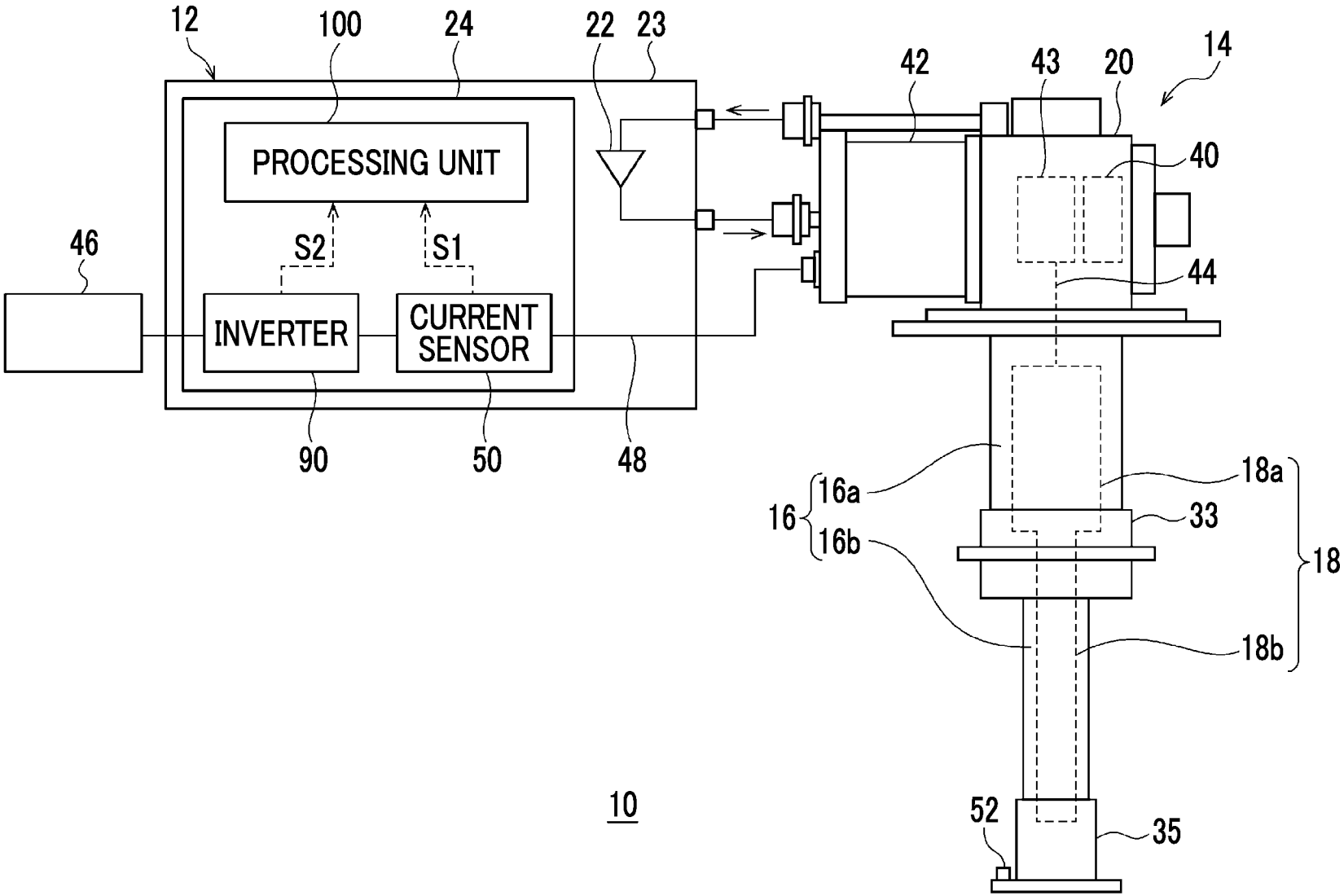
FIG. 1 is a diagram schematically showing a cryocooler according to an embodiment.
Figure 2:
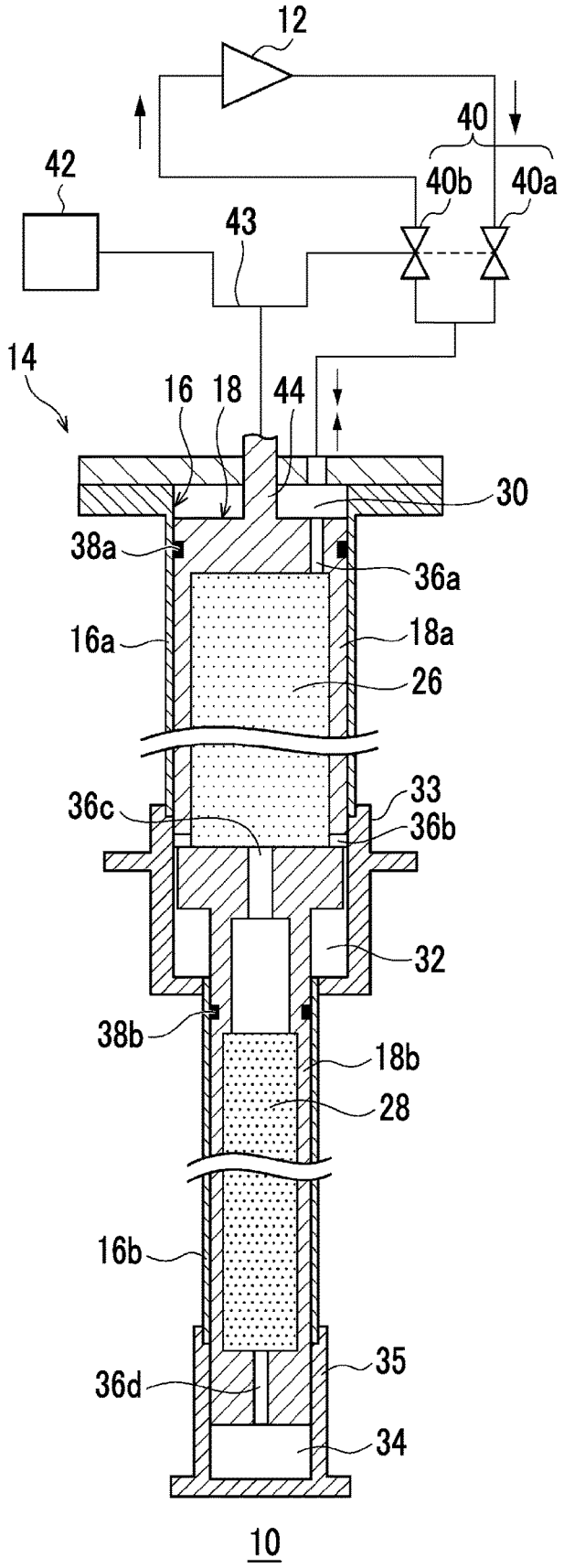
FIG. 2 is a diagram schematically showing the cryocooler according to the embodiment.

FIGS. 1 and 2 are views schematically showing a cryocooler 10 according to an embodiment. FIG. 1 shows an appearance of the cryocooler 10, and FIG. 2 shows an internal structure of the cryocooler 10. The cryocooler 10 is, for example, a two-stage type Gifford-McMahon (GM) cryocooler.

The cryocooler 10 includes a compressor 12 and an expander 14. Although the details will be described later, the cryocooler 10 includes a monitoring device that monitors an expander motor 42 that operates the expander 14, and the monitoring device includes a current sensor 50 and a processor or processing unit 100.

The compressor 12 is configured to collect a working gas of the cryocooler 10 from the expander 14, to pressurize the collected working gas, and to supply the working gas to the expander 14 again. The working gas is also called a refrigerant gas, and other suitable gases may be used although a helium gas is typically used.

In general, both of the pressure of a working gas supplied from the compressor 12 to the expander 14 and the pressure of a working gas collected from the expander 14 to the compressor 12 are considerably higher than the atmospheric pressure, and can also be called a first high pressure and a second high pressure, respectively. For convenience of description, the first high pressure and the second high pressure are simply called a high pressure and a low pressure, respectively. Typically, the high pressure is, for example, 2 to 3 MPa. The low pressure is, for example, 0.5 to 1.5 MPa, and is, for example, about 0.8 MPa. For better understanding, a direction in which the working gas flows is shown with arrows.

The compressor 12 includes a compressor main body 22 and a compressor casing 23 that accommodates the compressor main body 22. The compressor 12 will also be referred to as a compressor unit.

The compressor main body 22 is configured to internally compress the working gas sucked from a suction port and to discharge the working gas from a discharge port. The compressor main body 22 may be, for example, a scroll type pump, a rotary type pump, or other pumps that pressurize the working gas. The compressor main body 22 may be configured to discharge the working gas at a fixed and constant flow rate. Alternatively, the compressor main body 22 may be configured to change the flow rate of the working gas to be discharged. The compressor main body 22 will be referred to as a compression capsule in some cases.

The compressor 12 may include a compressor controller 24 that controls the compressor 12. The compressor controller 24 may not only control the compressor 12 but also control the cryocooler 10 in an integrated manner. For example, the expander 14 (for example, the expander motor 42) may also be controlled. The compressor controller 24 may be attached to the compressor 12, and may be installed on, for example, an outer surface of the compressor casing 23 and accommodated in the compressor casing 23. Alternatively, the compressor controller 24 may be disposed away from the compressor 12 and connected to the compressor 12 via, for example, a control signal line.

The expander 14 includes a cryocooler cylinder 16 and a displacer assembly 18. The cryocooler cylinder 16 guides linear reciprocating motion of the displacer assembly 18 and forms expansion chambers (32 and 34) for the working gas with the displacer assembly 18. The expander 14 includes a pressure switching valve 40 that determines an intake start timing of the working gas into the expansion chamber and an exhaust start timing of the working gas from the expansion chamber.

In the present specification, in order to describe a positional relationship between constituents of the cryocooler 10, for convenience of description, a side close to a top dead center of axial reciprocation of a displacer will be referred to as "up" and a side close to a bottom dead center will be referred to as "down". The top dead center is the position of the displacer at which the volume of an expansion space is maximum, and the bottom dead center is the position of the displacer at which the volume of the expansion space is minimum. Since a temperature gradient in which the temperature drops from an upper side to a lower side in an axial direction is generated during the operation of the cryocooler 10, the upper side can also be called a high temperature side and the lower side can also be called a low temperature side.

The cryocooler cylinder 16 includes a first cylinder 16*a* and a second cylinder 16*b*. The first cylinder 16*a* and the second cylinder 16*b* each are, for example, a member that has a cylindrical shape, and the second cylinder 16*b* has a diameter smaller than that of the first cylinder 16*a*. The first cylinder 16*a* and the second cylinder 16*b* are coaxially disposed, and a lower end of the first cylinder 16*a* is strongly connected to an upper end of the second cylinder 16*b*.

The displacer assembly 18 includes a first displacer 18*a* and a second displacer 18*b* that are connected to each other, and the displacers move integrally. The first displacer 18*a* and the second displacer 18*b* each are, for example, a member that has a cylindrical shape, and the second displacer 18*b* has a diameter smaller than that of the first displacer 18*a*. The first displacer 18*a* and the second displacer 18*b* are coaxially disposed.

The first displacer 18*a* is accommodated in the first cylinder 16*a*, and the second displacer 18*b* is accommodated in the second cylinder 16*b*. The first displacer 18*a* can reciprocate in the axial direction along the first cylinder 16*a*, and the second displacer 18*b* can reciprocate in the axial direction along the second cylinder 16*b*.

As shown in FIG. 2, the first displacer 18*a* accommodates a first regenerator 26. The first regenerator 26 is formed by filling a tubular main body portion of the first displacer 18*a* with, for example, a wire mesh made of, such as copper, or other appropriate first regenerator material. An upper lid portion and a lower lid portion of the first displacer 18*a* may be provided as members separate from the main body portion of the first displacer 18*a*, or the first regenerator material may be accommodated in the first displacer 18*a* by fixing the upper lid portion and the lower lid portion of the first displacer 18*a* to the main body through appropriate means such as fastening and welding.

Similarly, the second displacer 18*b* accommodates a second regenerator 28. The second regenerator 28 is formed by filling a tubular main body portion of the second displacer 18*b* with, for example, a non-magnetic regenerator material such as bismuth, a magnetic regenerator material such as $HoCu_2$, or other appropriate second regenerator material. The second regenerator material may be molded into a granular shape. An upper lid portion and a lower lid portion of the second displacer 18*b* may be provided as members separate from the main body portion of the second displacer 18*b*, or the second regenerator material may be accommodated in the second displacer 18*b* by fixing the upper lid portion and the lower lid portion of the second displacer 18*b* to the main body through appropriate means such as fastening and welding.

The displacer assembly 18 forms, inside the cryocooler cylinder 16, a room temperature chamber 30, a first expansion chamber 32, and a second expansion chamber 34. In order to exchange heat with a desired object or medium to be cooled by the cryocooler 10, the expander 14 includes a first cooling stage 33 and a second cooling stage 35. The room temperature chamber 30 is formed between the upper lid portion of the first displacer 18*a* and an upper portion of the first cylinder 16*a*. The first expansion chamber 32 is formed between the lower lid portion of the first displacer 18*a* and the first cooling stage 33. The second expansion chamber 34 is formed between the lower lid portion of the second displacer 18*b* and the second cooling stage 35. The first cooling stage 33 is fixed to a lower portion of the first cylinder 16*a* to surround the first expansion chamber 32, and the second cooling stage 35 is fixed to a lower portion of the second cylinder 16*b* to surround the second expansion chamber 34.

The first regenerator 26 is connected to the room temperature chamber 30 through a working gas flow path 36*a* formed in the upper lid portion of the first displacer 18*a*, and is connected to the first expansion chamber 32 through a working gas flow path 36*b* formed in the lower lid portion of the first displacer 18*a*. The second regenerator 28 is connected to the first regenerator 26 through a working gas flow path 36*c* formed from the lower lid portion of the first displacer 18*a* to the upper lid portion of the second displacer 18*b*. In addition, the second regenerator 28 is connected to the second expansion chamber 34 through a working gas flow path 36*d* formed in the lower lid portion of the second displacer 18*b*.

In order to introduce working gas flow between the first expansion chamber 32, the second expansion chamber 34, and the room temperature chamber 30 to the first regenerator 26 and the second regenerator 28 instead of a clearance between the cryocooler cylinder 16 and the displacer assembly 18, a first seal 38*a* and a second seal 38*b* may be provided. The first seal 38*a* may be mounted on the upper lid portion of the first displacer 18*a* to be disposed between the first displacer 18*a* and the first cylinder 16*a*. The second seal 38*b* may be mounted on the upper lid portion of the second displacer 18*b* to be disposed between the second displacer 18*b* and the second cylinder 16*b*.

As shown in FIG. 1, the expander 14 includes a cryocooler housing 20 that accommodates the pressure switching valve 40. The cryocooler housing 20 is coupled to the cryocooler cylinder 16, and accordingly a hermetic container that accommodates the pressure switching valve 40 and the displacer assembly 18 is configured.

As shown in FIG. 2, the pressure switching valve 40 is configured to include a high-pressure valve 40*a* and a low-pressure valve 40*b* and to generate periodic pressure variations in the cryocooler cylinder 16. A working gas discharge port of the compressor 12 is connected to the room temperature chamber 30 via the high-pressure valve 40*a*, and a working gas suction port of the compressor 12 is connected to the room temperature chamber 30 via the low-pressure valve 40*b*. The high-pressure valve 40*a* and the low-pressure valve 40*b* are configured to open and close selectively and alternately (that is, such that when one is open, the other is closed).

The pressure switching valve 40 may take a form of a rotary valve. That is, the pressure switching valve 40 may be configured such that the high-pressure valve 40*a* and the low-pressure valve 40*b* are alternately opened and closed through rotational sliding of a valve disk with respect to a stationary valve main body. In that case, the expander motor 42 may be connected to the pressure switching valve 40 so as to rotate the valve disk of the pressure switching valve 40. For example, the pressure switching valve 40 is disposed such that a valve rotation axis is coaxial with the rotary shaft of the expander motor 42.

Alternatively, the high-pressure valve 40*a* and the low-pressure valve 40*b* may be individually controllable valves. In this case, the pressure switching valve 40 may not be connected to the expander motor 42.

The expander 14 includes an expander motor 42 and a motion conversion mechanism 43. The expander motor 42 is attached to the cryocooler housing 20. The motion conversion mechanism 43 is accommodated in the cryocooler housing 20 in the same manner as the pressure switching valve 40.

The expander motor 42 is connected to the displacer drive shaft 44 via the motion conversion mechanism 43 such as a Scotch yoke mechanism. The motion conversion mechanism 43 converts the rotary motion output by the expander motor 42 into a linear reciprocating motion of the displacer drive shaft 44. The displacer drive shaft 44 extends from the motion conversion mechanism 43 into the room temperature chamber 30, and is fixed to the upper lid portion of the first displacer 18*a*. The rotation of the expander motor 42 is converted into axial reciprocation of the displacer drive shaft 44 by the motion conversion mechanism 43, and the displacer assembly 18 reciprocates linearly in the cryocooler cylinder 16 in the axial direction.

Incidentally, the cryocooler 10 is supplied with power from a power source 46 such as a commercial power source (three-phase alternating current power source). The power source 46 is connected to the compressor 12 and the expander motor 42 via a power supply wiring 48. Since the expander motor 42 is connected to the power source 46 via the compressor 12, the compressor 12 may also be regarded as a power source of the expander motor 42. The compressor 12 and the expander motor 42 may be connected to individual power sources.

The expander motor 42 is, for example, a permanent magnet type motor driven by a three-phase AC. An operation frequency of the expander motor 42 is controlled by an inverter 90. The inverter 90 is installed on the power supply wiring 48. The expander motor 42 can operate at a rotation speed corresponding to an operation frequency of the expander motor 42, which is equal to an output frequency of the inverter 90. As an example, the output frequency of the inverter 90 may vary in a range of 30 Hz to 100 Hz or a range of 40 Hz to 70 Hz.

The current sensor 50 is connected to the expander motor 42 to measure a current supplied from the inverter 90 to the expander motor 42 in at least a steady operation of the cryocooler 10. The current sensor 50 is installed on the power supply wiring 48 between the inverter 90 and the expander motor 42.

In addition, the current sensor 50 is configured to output a motor current signal S1 indicating the measured current to the processor 100. The motor current signal S1 may represent an effective value of a current supplied to the expander motor 42. The current sensor 50 is communicatively connected to the processor 100 by wire or wirelessly. The current sensor 50 may be a three-phase current meter that simultaneously measures individual three-phase currents flowing through the expander motor 42, or may be another type of current sensor that measures a current flowing through the expander motor 42. For example, the current sensor 50 may be configured to simultaneously measure the individual three-phase currents output from the inverter 90 to the expander motor 42, and output, as the motor current signal S1, for example, a voltage signal indicating a magnitude of each of the measured three-phase currents to the processor 100. The motor current signal S1 may be current waveform data indicating a temporal change of a current flowing through the expander motor 42 during the operation of the cryocooler 10.

The inverter 90 is configured to output the output frequency information S2 indicating the output frequency of the inverter 90 (that is, the operation frequency of the expander motor 42) to the processor 100. Alternatively, instead of the processor 100 receiving the output frequency information S2 from the inverter 90, the processor 100 may calculate the output frequency information S2 from the motor current signal S1 input from the current sensor 50. For example, the processor 100 may calculate an operation frequency of the expander motor 42 by counting the number of current peaks per unit time from a waveform of the current flowing through the expander motor 42.

Alternatively, the inverter 90 may include the current sensor 50 (the inverter 90 may be capable of measuring an output current), or the processor 100 may acquire the motor current signal S1 from the inverter 90. As the motor current signal S1, a signal having an effective value of a current output by the inverter 90 for controlling the expander motor 42 may be used.

The processor 100 is configured to receive the motor current signal S1 from the current sensor 50 (or the inverter 90) and monitor the expander motor 42 on the basis of the motor current signal S1 in at least a steady operation of the cryocooler 10. Details of the processor 100 will be described later.

In the shown example, the current sensor 50, the inverter 90, and the processor 100 are built in the compressor controller 24 and are provided in the compressor 12, but the present invention is not limited to this. The current sensor 50, the inverter 90, and the processor 100 may be provided in the expander 14, such as being mounted on the expander motor 42, or may be provided in other locations on the power supply wiring 48.

When the compressor 12 and the expander motor 42 are operated, the cryocooler 10 generates periodic volume variations in the first expansion chamber 32 and the second expansion chamber 34 and pressure variations of the working gas synchronized with the periodic volume variations. Typically, in the intake step, the low-pressure valve 40*b* is closed and the high-pressure valve 40*a* is opened, and thus the high-pressure working gas flows from the compressor 12 into the room temperature chamber 30 through the high-pressure valve 40*a* and is supplied to the first expansion chamber 32 through the first regenerator 26 and supplied to the second expansion chamber 34 through the second regenerator 28. As described above, the first expansion chamber 32 and the second expansion chamber 34 are pressurized from the low pressure to the high pressure. In this case, the displacer assembly 18 is moved upward from the bottom dead center to the top dead center, and the volumes of the first expansion chamber 32 and the second expansion chamber 34 are increased. When the high-pressure valve 40*a* is closed, the intake process is ended.

In the exhaust step, the high-pressure valve 40*a* is closed and the low-pressure valve 40*b* is opened such that the first expansion chamber 32 and the second expansion chamber 34 are opened to the low-pressure working gas suction port of the compressor 12. Therefore, the working gas is expanded in the first expansion chamber 32 and the second expansion chamber 34, and as a result, the working gas having a low pressure is discharged to the room temperature chamber 30 from the first expansion chamber 32 and the second expansion chamber 34 through the first regenerator 26 and the second regenerator 28. In this case, the displacer assembly 18 is moved downward from the top dead center to the bottom dead center, and the volumes of the first expansion chamber 32 and the second expansion chamber 34 are reduced. The working gas is collected from the expander 14 to the compressor 12 through the low-pressure valve 40*b*. When the low-pressure valve 40*b* is closed, the exhaust process is ended.

As described above, for example, a refrigeration cycle such as a GM cycle is configured, and the first cooling stage 33 and the second cooling stage 35 are cooled to a desired cryogenic temperature. The first cooling stage 33 may be cooled to a first cooling temperature within a range of, for example, about 20 K to about 40 K. The second cooling stage 35 may be cooled to a second cooling temperature (for example, about 1 K to about 4 K) lower than the first cooling temperature.

The cryocooler 10 can perform a steady operation and a cool-down operation prior to the steady operation. The cool-down operation is an operation mode in which the cryocooler 10 is rapidly cooled from a room temperature to a cryogenic temperature when the cryocooler 10 is started, and the steady operation is an operation mode in which the cryocooler 10 is maintained in a state of being cooled to the cryogenic temperature due to the cool-down operation. The cryocooler 10 is cooled to a standard cooling temperature through the cool-down operation, and is maintained within an allowable temperature range of a cryogenic temperature including the standard cooling temperature in the steady operation. The standard cooling temperature is different depending on applications and settings of the cryocooler 10, but is typically about 4.2 K or less in, for example, a cooling application of a superconducting device. In some other cooling applications, the standard cooling temperature may be, for example, about 10 K to 20 K or 10 K or less.

Switching from the cool-down operation to the steady operation is controlled by a controller (for example, the compressor controller 24) that controls the cryocooler 10. The cryocooler 10 may include a temperature sensor 52 that measures the temperature of the second cooling stage 35 (and/or the first cooling stage 33) and outputs a measured temperature signal indicating the measured temperature. The compressor controller 24 may compare the measured temperature of the second cooling stage 35 with the standard cooling temperature (or the above-described allowable temperature range) on the basis of the measured temperature signal from the temperature sensor 52, and execute the cool-down operation in a case where the measured temperature is higher than the standard cooling temperature, and may transition from the cool-down operation to the steady operation in a case where the measured temperature is equal to or lower than the standard cooling temperature.

The inverter 90 can operate to drive the expander motor 42 in the steady operation at a lower operation frequency than in the cool-down operation. For example, the inverter 90 may drive the expander motor 42 at a preset first operation frequency in the cool-down operation under the control of a controller (for example, the compressor controller 24), and drive the expander motor 42 at a preset second operation frequency in the steady operation. Here, the second operation frequency is lower than the first operation frequency. The controller may control the expander motor 42 on the basis of a measured temperature signal from the temperature sensor 52 and a preset operation frequency profile, and the operation frequency profile may be set to provide a higher operation frequency as the measured temperature becomes higher.

Alternatively, a controller (for example, the compressor controller 24) may control an output frequency of the inverter 90 such that a deviation of the measured temperature from the standard cooling temperature is minimized (for example, by using feedback control such as PID control) on the basis of the measured temperature signal from the temperature sensor 52. Therefore, the operation frequency of the expander motor 42 is increased in a case where the measured temperature of the temperature sensor 52 is higher than the standard cooling temperature, and the operation frequency of the expander motor 42 is decreased in a case where the measured temperature of the temperature sensor 52 is lower than the standard cooling temperature. Therefore, in the cool-down operation, an initially measured temperature is a room temperature, and, in this case, an operation frequency of the expander motor 42 is considerably high, and thus rapid cooling can be performed. The operation frequency decreases as the temperature decreases toward the standard cooling temperature. In the steady operation, in a case where the measured temperature is higher than the standard cooling temperature due to disturbance such as heat intrusion from the surroundings, the operation frequency of the expander motor 42 is increased and the cryocooler 10 is cooled again to the standard cooling temperature. On the contrary, when the measured temperature becomes lower than the standard cooling temperature due to, for example, a decrease in the heat load, the operation frequency of the expander motor 42 is reduced and the cryocooler 10 is returned to the standard cooling temperature. Excessive cooling can be avoided, and the standard cooling temperature can be maintained.

Incidentally, as the cryocooler 10 is operated for a long period of time, a load applied to the expander motor 42 tends to gradually increase. As the cause, for example, various fine particles derived from a lubricating oil or a regenerator material in the compressor 12 are accumulated in the expander 14, and thus a pressure loss in the expander 14 increases, and a load applied to the expander motor 42 gradually increases over a long period of time due to inflow and outflow of the working gas to and from the expansion chamber. In addition, as the cause, moisture is absorbed by the displacer in the expander 14, and thus the displacer slightly expands in the expander 14, so that the clearance with the cylinder is reduced and the sliding resistance of the displacer increases.

Since a drive load of the expander motor 42 increases as described above, there is an increasing risk that a load torque exceeding a specification limit of the motor (for example, an instantaneous maximum torque or other rated torque) is applied to the expander motor 42. A load exceeding the specification limit of the expander motor 42 causes an abnormal operation or a failure such as step-out of the expander motor 42, which causes abnormal noise in the expander 14 or hinders a normal operation of the expander 14.

By monitoring a current flowing through the expander motor 42 and detecting abnormal variations of the current accompanying the abnormality of the expander motor 42, it is possible to ascertain the occurrence of abnormality in the expander motor 42. However, in a case where an operation frequency (rotation speed) of the expander motor 42 is controlled by the inverter 90, a motor current varies not only when an abnormality occurs in the expander motor 42 but also when the operation frequency is changed during a normal operation. Also in a case where an external magnetic field acts on the expander motor 42 as in a case where the expander 14 is installed in a strong magnetic field environment, a motor current may vary according to a magnitude of the magnetic field. The motor current may also vary even in a case where an input voltage to the inverter 90 varies. Since the motor current may vary depending on various operation conditions of the expander motor 42, it is not always easy to distinguish an abnormal variation of the current accompanying the abnormality of the expander motor 42 from a variation of the current caused by changes of the operation conditions during the normal operation of the expander motor 42.

Figure 3:
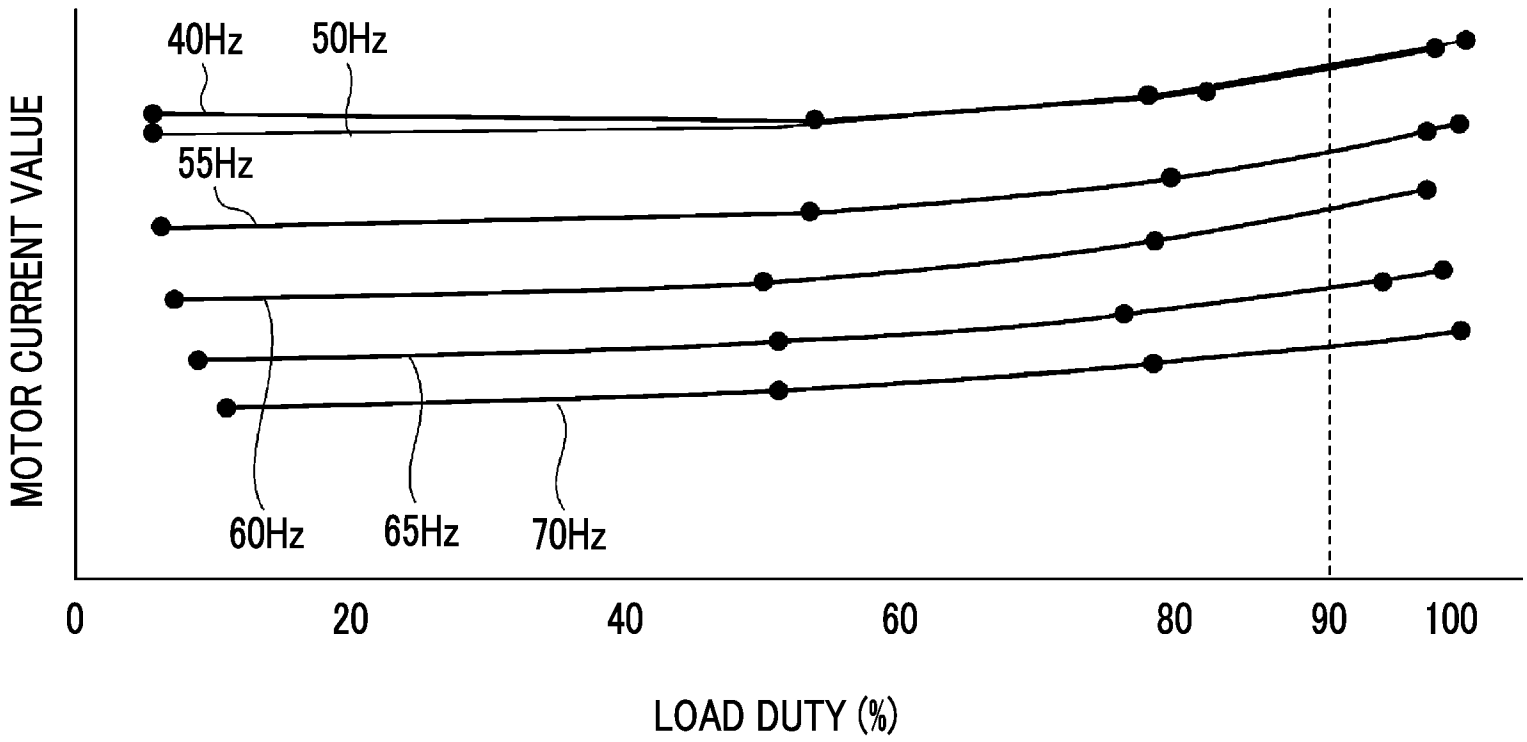
FIG. 3 is a graph showing results of measuring a relationship between an effective value of a current flowing through an expander motor and a load duty for a plurality of operation frequency values.

FIG. 3 is a graph showing results of measuring a relationship between an effective value of a current flowing through the expander motor 42 and a load duty for values of a plurality of operation frequencies. A vertical axis shows an effective value of a current supplied from the inverter 90 to the expander motor 42 and measured by the current sensor 50. A load duty shown on a horizontal axis indicates a ratio (%) of the load torque actually acting on the expander motor 42 to the maximum load torque (for example, instantaneous maximum torque) allowed for the expander motor 42. Therefore, when the load duty exceeds 100%, an abnormal operation such as step-out may actually occur in the expander motor 42 or a probability thereof is high.

As can be understood from FIG. 3, for a given load duty (any value may be used, for example, 90%), motor current values are controlled by the inverter to be substantially the same when the operation frequency is 40 Hz and when the operation frequency is 50 Hz. As described above, in a case where the value of the operation frequency is relatively low, the motor current value hardly depends on the operation frequency. On the other hand, in the example in FIG. 3, in the operation frequency range of 50 Hz to 70 Hz, the motor current value decreases as the value of the operation frequency increases. As described above, in a case where the value of the operation frequency is relatively high, the motor current value may be dependent on the operation frequency, and the motor current value may be different depending on the value of the operation frequency.

Next, for a given operation frequency, a change in the motor current value when the load duty changes is observed. Although the motor current value is different for each of the operation frequency values, it can be seen that the motor current value tends to increase as the load duty increases.

Therefore, for a value of a certain operation frequency (for example, 60 Hz), a motor current value when a load duty is lower than 100% and sufficiently high (for example, 90% to 98%) may be used as a current threshold. When a current exceeding this current threshold flows through the expander motor 42 (that is, when the current is measured by the current sensor 50), a large load corresponding to the load duty is applied to the expander motor 42. This is regarded as prediction of the occurrence of an abnormal operation of the expander motor 42, and measures such as issuing a warning, lowering an operation frequency, and stopping an operation of the cryocooler 10, can be taken to prevent the occurrence of an abnormal operation.

However, when the expander motor 42 is driven at a higher operation frequency value (for example, 70 Hz), a motor current value becomes considerably smaller than that at 60 Hz described above, and does not reach the current threshold set for 60 Hz. Therefore, even though the motor current value at 70 Hz operation of the expander motor 42 is compared with the threshold for 60 Hz, an effective result for predicting the occurrence of abnormality of the expander motor 42 cannot be obtained. On the contrary, when the expander motor 42 is driven at a lower operation frequency value (for example, 50 Hz), a motor current value becomes considerably larger than that at 60 Hz described above, and exceeds the current threshold set for 60 Hz even for a considerably small load duty. Similarly, even though the motor current value at 50 Hz operation of the expander motor 42 is compared with the threshold for 60 Hz, an effective result for predicting the occurrence of abnormality of the expander motor 42 cannot be obtained.

Figure 4:
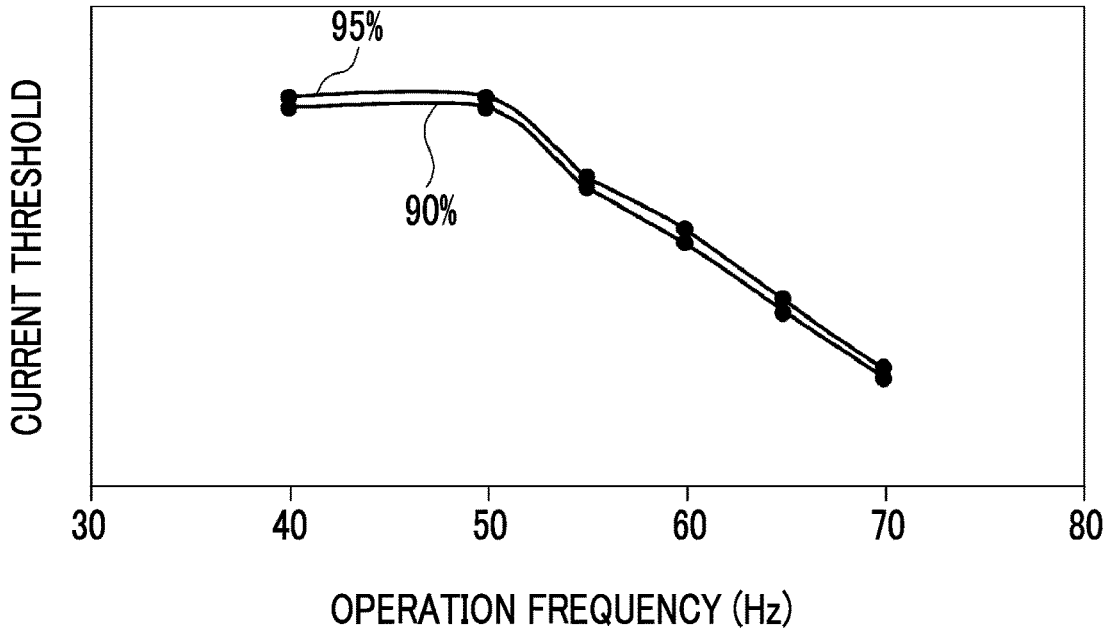
FIG. 4 shows an example of a relationship between an operation frequency of the expander motor and a current threshold according to the embodiment.

Thus, in a case where an operation frequency of the expander motor 42 is controlled by the inverter 90, it is difficult to predict or prevent an abnormal operation or a failure of the expander motor 42 by monitoring a current flowing through the expander motor 42 by setting only one current threshold. Therefore, in the embodiment, a current threshold is set for each of a plurality of values of operation frequencies of the expander motor 42. FIG. 4 illustrates a plurality of such current thresholds.

FIG. 4 shows an example of a relationship between an operation frequency of the expander motor 42 and a current threshold according to the embodiment. FIG. 4 shows a relationship between a motor current value and a load duty according to the operation frequency shown in FIG. 3 for specific load duty values (specifically, load duties of 90% and 95%). Therefore, as described above, when the operation frequency is relatively low (in the operation frequency range of 40 Hz to 50 Hz in FIG. 4), the motor current value is substantially constant. When the operation frequency is relatively high (in the operation frequency range of 50 Hz to 70 Hz in FIG. 4), the motor current value decreases as the value of the operation frequency increases. As can be seen from FIG. 4, as the load duty value increases, the motor current value increases.

The relationship between the operation frequency of the expander motor 42 and the current threshold shown in FIG. 4 may be used as an example of an operation frequency/current threshold table 62 that will be described later. In a case where a combination of the value of the operation frequency and the value of the motor current to be measured is in a region above the graph (that is, in a case where the expander motor 42 is driven at the operation frequency, and a current value measured by the current sensor 50 at this time exceeds the current threshold corresponding to the operation frequency), it can be considered that the occurrence of an abnormal operation of the expander motor 42 is predicted. When the combination of the operation frequency value and the measured motor current value is in the region below the graph, the measured current value does not exceed the current threshold, and thus it can be considered that no abnormality occurs.

As described above, by respectively associating a plurality of current thresholds with a plurality of values of the operation frequencies of the expander motor 42, even in a case where the operation frequency of the expander motor 42 is controlled by the inverter 90, it is possible to favorably determine whether an abnormal operation such as step-out actually occurs or a probability thereof is high. Therefore, it is possible to take measures to prevent such an abnormal operation of the expander motor 42.

Depending on applications of the cryocooler 10 (for example, in a case of cooling a superconducting electromagnet), the expander 14 may be installed and used in a strong magnetic field environment. In such a case, an external magnetic field acting on the expander motor 42 may influence an operation of the expander motor 42 and may vary a current flowing through the expander motor 42. According to the study of the present inventor, the motor current value tends to increase as the external magnetic field increases under a given load duty at a given operation frequency. In particular, in the case where the expander motor 42 is a permanent magnet type motor, there is such a tendency. As an exemplary operation condition, when the operation frequency is 50 Hz or 60 Hz and the load duty is 90% or more, the motor current value can be increased by, for example, about 5% to 10% in a case where the external magnetic field is 500 gauss compared with a case where the external magnetic field is 0 gauss.

In addition, typically, due to the specifications of the cryocooler 10, an input voltage from the power source 46 to the inverter 90 is allowed to vary to some extent (for example, about ±10%). Even in a case where an input voltage to the inverter 90 varies, a current flowing through the expander motor 42 may vary. According to the study of the present inventor, the motor current value tends to increases as an input voltage increases from a voltage value lower than a specified voltage value (for example, 200 V) of the power source 46 to the specified voltage value under a given load duty at a given operation frequency.

Therefore, for not only an operation frequency of the expander motor 42 but also other operation conditions of the expander motor 42 such as an external magnetic field and an input voltage, by respectively associating a plurality of current thresholds with a plurality of values of the operation conditions, it is possible to favorably determine that an abnormal operation of the expander motor 42 may occur and take measures to prevent this from occurring.

Figure 5:
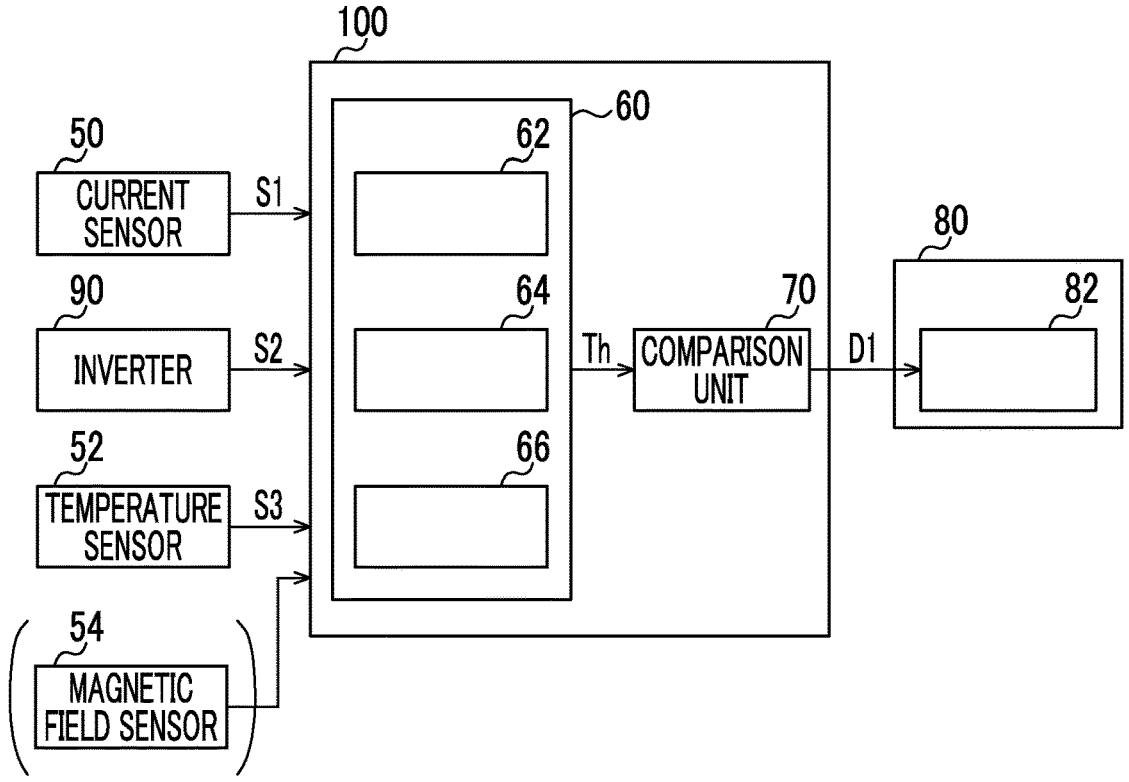
FIG. 5 is a block diagram of a motor monitoring device according to the embodiment.

FIG. 5 is a block diagram of a motor monitoring device according to the embodiment. This monitoring device includes a processor 100, and the processor 100 includes a current threshold setting unit 60 and a comparison unit 70. The current threshold setting unit 60 includes an operation frequency/current threshold table 62, an external magnetic field/current threshold table 64, and an input voltage/current threshold table 66. The monitoring device may include a notifier 80 that provides a visual notification of information indicating a monitoring result, and the notifier 80 may include, for example, a display 82. The notifier 80 may provide a notification of a diagnosis result with sound by using a speaker or the like. The notifier 80 may transmit a diagnosis result to a remote device via a network such as the Internet.

The processor 100 is configured to monitor the expander motor 42 on the basis of at least the motor current signal S1 in at least the steady operation. Therefore, the processor 100 may acquire information indicating the current operation mode of the cryocooler 10 from a controller (for example, the compressor controller 24), or determine the current operation mode on the basis of the measured temperature signal S3 from the temperature sensor 52, and monitor the expander motor 42 on the basis of the motor current signal S1 in a case where the current operation mode is a steady operation. In addition to or instead of this, the processor 100 may monitor the expander motor 42 on the basis of the motor current signal S1 in a case where the current operation mode is the cool-down operation.

The processor 100 is configured to acquire a current threshold Th on the basis of operation conditions of the expander motor 42, and monitor the expander motor 42 by comparing a current (for example, an effective value of the current) of the expander motor 42 with the current threshold Th on the basis of the motor current signal S1. Therefore, the current threshold setting unit 60 uses at least one current threshold table among the operation frequency/current threshold table 62, the external magnetic field/current threshold table 64, and the input voltage/current threshold table 66 to acquire the current threshold Th on the basis of the operation conditions of the expander motor 42 (for example, the motor current signal S1, the output frequency information S2, a magnitude of an external magnetic field, and an input voltage to the inverter 90).

The operation frequency/current threshold table 62 is a table in which a plurality of current thresholds are respectively associated with a plurality of values of operation frequencies of the expander motor 42, the external magnetic field/current threshold table 64 is a table in which a plurality of values of external magnetic fields applied to the expander motor 42 are respectively associated with a plurality of current thresholds, and the input voltage/current threshold table 66 is a table in which a plurality of current thresholds are respectively associated with a plurality of values of input voltages to the inverter 90. The operation frequency/current threshold table 62, the external magnetic field/current threshold table 64, and the input voltage/current threshold table 66 are set in advance and stored in the processor 100. These current threshold tables can be set as appropriate on the basis of the empirical knowledge of a designer or experiments or simulations by the designer.

For example, the current threshold setting unit 60 is configured to, on the basis of the operation frequency/current threshold table 62 and a value of an operation frequency of the expander motor 42, acquire the current threshold Th corresponding to the value of the operation frequency.

For example, as shown in FIG. 4, the operation frequency/current threshold table 62 may be a table in which a plurality of current thresholds are respectively associated with a plurality of values of operation frequencies of the expander motor 42 such that a current threshold is reduced as an operation frequency increases in at least a part of an operation frequency range of the expander motor 42 that can be controlled by the inverter 90 (for example, a region on the high frequency side of the range).

In the operation frequency/current threshold table 62, for each of the plurality of values of the operation frequencies of the expander motor 42, when a load torque, by a predetermined amount, smaller than the maximum load torque allowed for the expander motor 42 acts on the expander motor 42 (that is, when a load duty is a predetermined value), a current value of the expander motor 42 under the value of the operation frequency may be associated with the value of the operation frequency as a current threshold. The load duty of a predetermined value may be selected from, for example, a range of 80% or more and less than 100%, or a range of 90% or more and 98% or less.

A plurality of operation frequency/current threshold tables 62 may be set in advance, and the plurality of operation frequency/current threshold tables 62 may be respectively associated with a plurality of different load duty values. The current threshold setting unit 60 may acquire, on the basis of the operation frequency/current threshold table 62 selected from among the plurality of operation frequency/current threshold tables 62 and a value of the operation frequency of the expander motor 42, the current threshold Th corresponding to the value of the operation frequency.

The current threshold setting unit 60 may be configured to, on the basis of the external magnetic field/current threshold table 64 and a value of an external magnetic field applied to the expander motor 42, acquire the current threshold Th corresponding to the value of the external magnetic field. A value of an external magnetic field may be measured by a magnetic field sensor 54 mounted on or installed near the cryocooler 10 (for example, the expander 14), and the measured value of the external magnetic field may be input to the processor 100 and used by the current threshold setting unit 60.

Alternatively, the processor 100 may be configured to acquire an estimated value of an external magnetic field applied to the expander motor 42 on the basis of the motor current signal S1, and acquire the current threshold Th corresponding to the estimated value of the external magnetic field on the basis of the external magnetic field/current threshold table 64 and the estimated value of the external magnetic field applied to and the expander motor 42. According to the study of the present inventor, waveforms of three-phase currents flowing through the expander motor 42 have symmetry when an external magnetic field does not act or the external magnetic field is sufficiently small, whereas the waveforms of the three-phase currents tend to have increasing asymmetry as the external magnetic field increases. Examples of this asymmetry include a deviation between peak values of current waveforms of three phases (a U phase, a V phase, and a W phase). In particular, in a case where a coil wiring of the expander motor 42 has a star connection, an increasing tendency of the asymmetry of the current waveform according to an external magnetic field may become remarkable due to the generation of an unbalanced current. For example, on the basis of an external magnetic field origin parameter that can be calculated from the motor current signal S1 such as the maximum value or the minimum value of the peaks of the current waveforms of the U phase, the V phase, and the W phase, or a difference between the maximum value and the minimum value, an estimated value of an external magnetic field of the expander motor 42 may be acquired from the motor current signal S1.

The current threshold setting unit 60 may be configured to, on the basis of the input voltage/current threshold table 66 and a value of an input voltage to the inverter 90, acquire the current threshold Th corresponding to the value of the input voltage. Information indicating the value of the input voltage to the inverter 90 may be input from the inverter 90 to the processor 100 and used by the current threshold setting unit 60.

A plurality of external magnetic field/current threshold tables 64 may be set in advance, and the plurality of external magnetic field/current threshold tables 64 may be respectively associated with values of a plurality of different operation frequencies. That is, for example, the first and second external magnetic field/current threshold tables 64 may be set in advance, and the first external magnetic field/current threshold table 64 may be used in a case where the expander motor 42 is driven at a value of a first operation frequency (for example, 70 Hz), and the second external magnetic field/current threshold table 64 may be used in a case where the expander motor 42 is driven at a value of a second operation frequency (for example, 60 Hz) different from the value of the first operation frequency. Similarly, a plurality of input voltage/current threshold tables 66 may be set in advance, and the plurality of input voltage/current threshold tables 66 may be respectively associated with values of a plurality of different operation frequencies.

The comparison unit 70 compares a current (for example, an effective value of the current) of the expander motor 42 with the acquired current threshold Th on the basis of the motor current signal S1, and generates monitoring result data D1 on the basis of a comparison result. The monitoring result data D1 is sent to the notifier 80, and a user is notified of the monitoring result, for example, by displaying the monitoring result on the display 82. In a case where the occurrence of an abnormal operation of the expander motor 42 is predicted, the notifier 80 may notify the user with an alarm sound. Instead of (or together with) an immediate notification as described above, the monitoring result data D1 may be stored in the processor 100 such that the monitoring result data D1 can be presented to the user as necessary.

An internal configuration of the processor 100 is realized by an element or a circuit including a CPU and a memory of a computer as a hardware configuration and is realized by a computer program as a software configuration, but is shown in the drawings as appropriate as a functional block realized in cooperation therebetween. It is clear for those skilled in the art that such a functional block can be realized in various manners through combination between hardware and software.

For example, the processor 100 can be implemented by combining a (hardware) processor such as a central processing unit (CPU) or a microcomputer and a software program executed by the processor. For example, such a hardware processor may be configured by a programmable logic device such as a field programmable gate array (FPGA), or may be a control circuit such as a programmable logic controller (PLC). The software program may be a computer program for causing the processor 100 to monitor the cryocooler 10.

Figure 6:
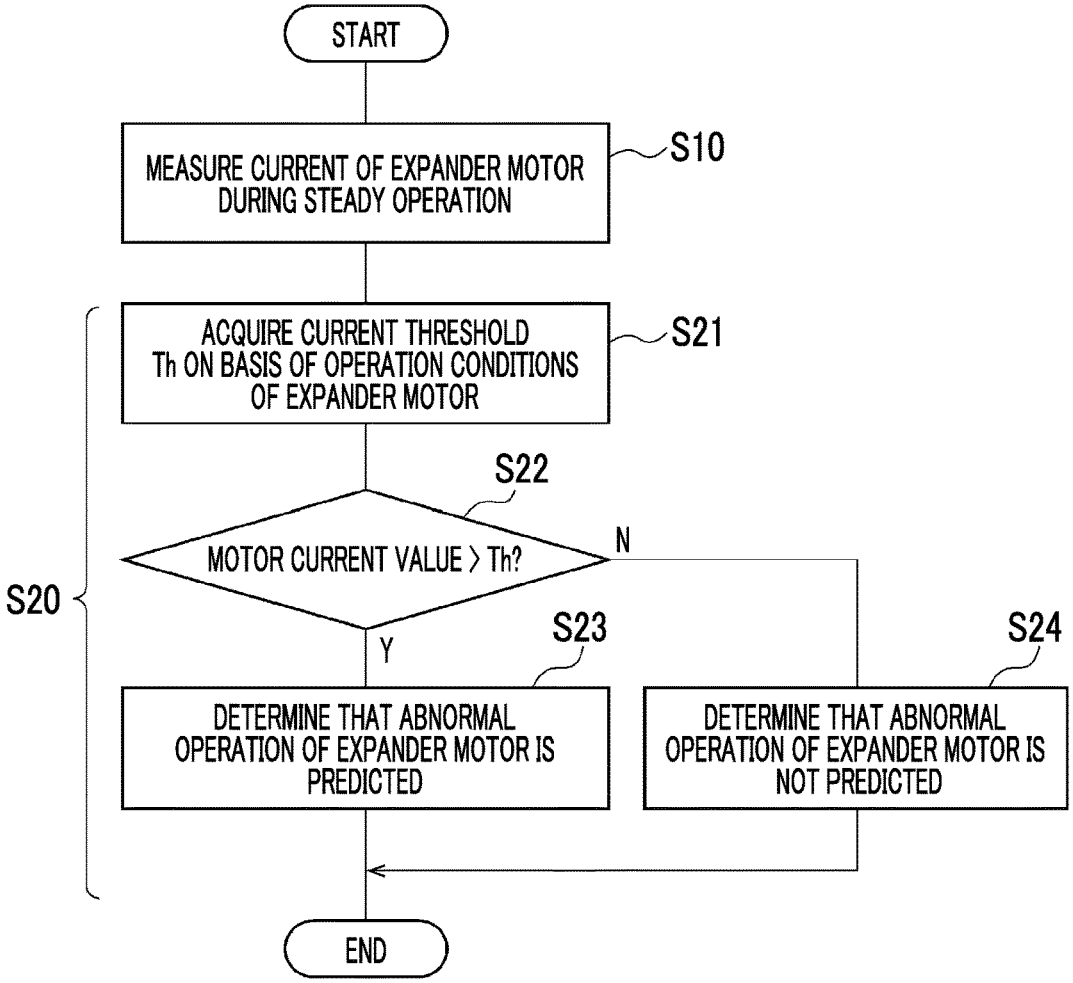
FIG. 6 is a flowchart showing a monitoring method for the cryocooler according to the embodiment.

FIG. 6 is a flowchart showing a monitoring method for the cryocooler 10 according to the embodiment. First, as shown in FIG. 6, a current supplied from the inverter 90 to the expander motor 42 is measured by the current sensor 50 during an operation of the cryocooler 10 (for example, during a steady operation) (S10). The expander motor 42 is monitored on the basis of at least the current of the expander motor 42 in steady operation (S20).

In S20, the current threshold Th is acquired on the basis of operation conditions of the expander motor 42 (for example, the motor current signal S1, the output frequency information S2, a magnitude of an external magnetic field, and an input voltage to the inverter 90) (S21). The measured current value of the expander motor 42 is compared with the acquired current threshold Th (S22). In a case where the measured current value exceeds the current threshold Th (Y in S22), the comparison unit 70 determines that the occurrence of an abnormal operation of the expander motor 42 is predicted (S23), and outputs the monitoring result data D1 indicating that fact. In a case where the measured current value is equal to or less than the current threshold Th (N in S22), the comparison unit 70 determines that the occurrence of an abnormal operation of the expander motor 42 is not predicted (S24), and outputs the monitoring result data D1 indicating the fact. As described above, the present monitoring method is ended.

In a case where the occurrence of an abnormal operation of the expander motor 42 is predicted, a controller (for example, the compressor controller 24) of the cryocooler 10 may take measures such as issuing a warning, lowering an operation frequency of the expander motor 42, and stopping an operation of the cryocooler 10, to prevent the occurrence of an abnormal operation.

The processor 100 periodically and repeatedly executes such monitoring. An increase in a drive load on the expander motor 42 is a long-term phenomenon that gradually progresses over a long span. Therefore, when this monitoring method is performed occasionally during an operation (for example, a steady operation) of the cryocooler 10, the method is sufficient to be practically used. Alternatively, the monitoring method may be constantly and repeatedly performed during an operation of the cryocooler 10.

In a case where the cryocooler 10 is continuously operated for a long period of time, the cryocooler 10 is in a steady operation during most of the operation time. By performing monitoring during the steady operation, it is possible to ascertain an increase in the load torque to the expander motor 42, which gradually increases due to deterioration in the constituents of the cryocooler 10 over time.

As described above, according to the embodiment, a current supplied from the inverter 90 to the expander motor 42 is measured, and it is possible to predict or prevent an abnormal operation or a failure of the expander motor 42 due to long-term operation by monitoring the expander motor 42 on the basis of a current (for example, an effective value of the current) of the expander motor 42 in at least a steady operation.

In a case where a load increase of the expander motor 42 is left unattended, the cryocooler 10 may eventually fail. In a case where the cryocooler 10 fails, an operation of a cryogenic system (for example, a superconducting apparatus or an MRI system) that uses the cryocooler 10 is required to be stopped until maintenance such as repair of the cryocooler or replacement with a new one is completed. In the case of a sudden failure, the time required for recovery tends to be relatively long.

However, according to the embodiment, it is possible to monitor the expander motor 42 and notify a user of the cryocooler 10 or a serviceman who performs maintenance of the cryocooler 10 of a monitoring result. It is possible to take measures to minimize the influence on an operation of the cryogenic system on the basis of the monitoring result.

Incidentally, in a certain embodiment, an output voltage from the inverter 90 (that is, an input voltage to the expander motor 42) may be different from an input voltage to the inverter 90. For example, the inverter 90 may be capable of limiting an output voltage to a specified voltage value in a case where an input voltage exceeds the specified voltage value (for example, 200 V). However, the inverter 90 is not required to be capable of increasing a voltage. In this case, in a case where the input voltage does not reach the specified voltage value, the input voltage and the output voltage are equal to each other, but when the input voltage exceeds the specified voltage value, the input voltage and the output voltage are different (the output voltage is smaller than the input voltage). As another example, an input voltage and an output voltage may be different depending on a method in which the inverter 90 controls a motor operation frequency. For example, in typical Vf control, even when an input voltage is a specified voltage value, an output voltage may be lower than the specified voltage value depending on an operation frequency.

Therefore, in addition to the motor operation conditions described above such as the operation frequency (or instead of any parameter among those operation conditions), an output voltage may be used as an example of a parameter referenced to set the current threshold.

Figure 7:
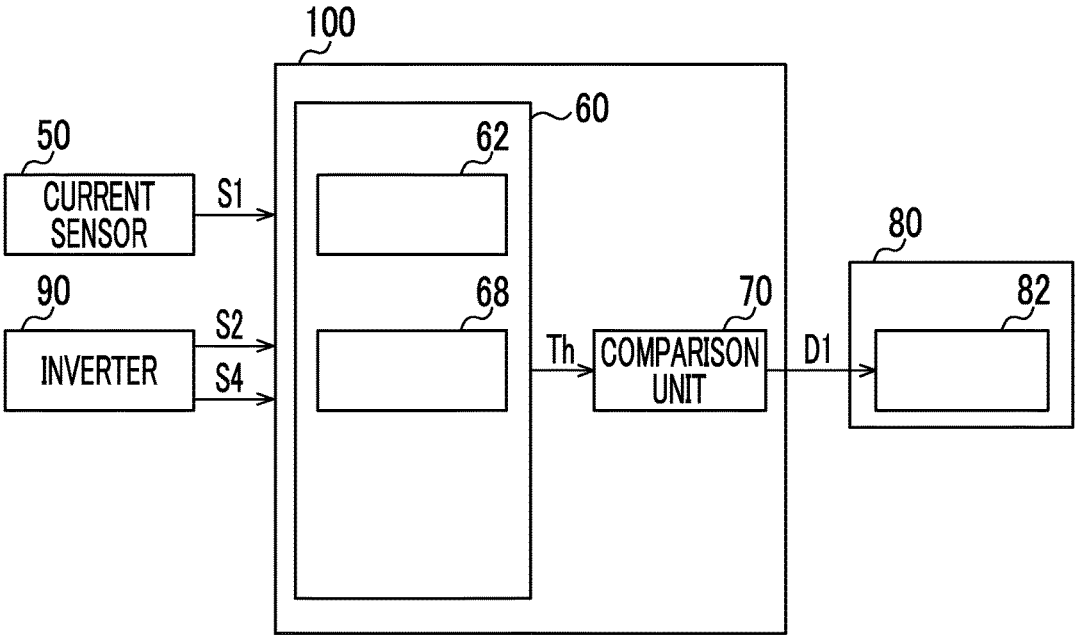
FIG. 7 is a block diagram of the motor monitoring device according to the embodiment.

FIG. 7 is a block diagram of the motor monitoring device according to the embodiment. The monitoring device includes the processor 100 configured to monitor the expander motor 42 on the basis of the motor current signal S1 from the current sensor 50. The processor 100 may monitor the expander motor 42 in at least a steady operation of the cryocooler 10. The monitoring device may include the notifier 80 for providing a notification of information indicating a monitoring result, and the notifier 80 may include, for example, the display 82.

The processor 100 is configured to acquire a current threshold Th on the basis of operation conditions of the expander motor 42, and monitor the expander motor 42 by comparing a current (for example, an effective value of the current) of the expander motor 42 with the current threshold Th on the basis of the motor current signal S1.

The processor 100 includes the current threshold setting unit 60 and the comparison unit 70. The current threshold setting unit 60 includes the operation frequency/current threshold table 62 and the output voltage/current threshold table 68. The operation frequency/current threshold table 62 is a table in which a plurality of current thresholds are respectively associated with a plurality of values of operation frequencies of the expander motor 42, and the output voltage/current threshold table 68 is a table in which a plurality of current thresholds are respectively associated with a plurality of values of output voltages from the inverter 90. These current threshold tables are set in advance and stored in the processor 100. These current threshold tables can be set as appropriate on the basis of the empirical knowledge of a designer or experiments or simulations by the designer.

For example, the current threshold setting unit 60 is configured to, on the basis of the operation frequency/current threshold table 62 and a value of an operation frequency of the expander motor 42, acquire the current threshold Th corresponding to the value of the operation frequency. The inverter 90 is configured to output the output frequency information S2 indicating a value of an output frequency of the inverter 90 (that is, an operation frequency of the expander motor 42) to the processor 100.

The current threshold setting unit 60 may be configured to, on the basis of the output voltage/current threshold table 68 and a value of an output voltage from the inverter 90, acquire the current threshold Th corresponding to the value of the output voltage. Information indicating the value of the output voltage from the inverter 90 may be input from the inverter 90 to the processor 100 and used by the current threshold setting unit 60. For example, the inverter 90 may be configured to output an output voltage signal S4 indicating a value of an output voltage (that is, an input voltage to the expander motor 42) of the inverter 90 to the processor 100 in addition to the output frequency information S2.

A plurality of output voltage/current threshold tables 68 may be set in advance, and the plurality of output voltage/current threshold tables 68 may be respectively associated with values of a plurality of different operation frequencies. For example, the first and second output voltage/current threshold tables 68 may be set in advance, and the first output voltage/current threshold table 68 may be used in a case where the expander motor 42 is driven at a value of a first operation frequency (for example, 70 Hz), and the second output voltage/current threshold table 68 may be used in a case where the expander motor 42 is driven at a value of a second operation frequency (for example, 60 Hz) different from the value of the first operation frequency.

The comparison unit 70 compares a current (for example, an effective value of the current) of the expander motor 42 with the acquired current threshold Th on the basis of the motor current signal S1, and generates monitoring result data D1 on the basis of a comparison result. Similar to the embodiment described with reference to FIG. 5, the monitoring result data D1 is sent to the notifier 80, and a user is notified of the monitoring result, for example, by displaying the monitoring result on the display 82.

Even in this manner, by monitoring the expander motor 42 on the basis of a current of the expander motor 42 (for example, an effective value of the current), it is possible to predict or prevent an abnormal operation or a failure of the expander motor 42 due to long-term operation.

In the above-described embodiment, monitoring based on a motor current has been described as an example, but monitoring based on power consumption of the inverter 90 or the expander motor 42 may be similarly performed. Such embodiments will be described below.

Figure 8:
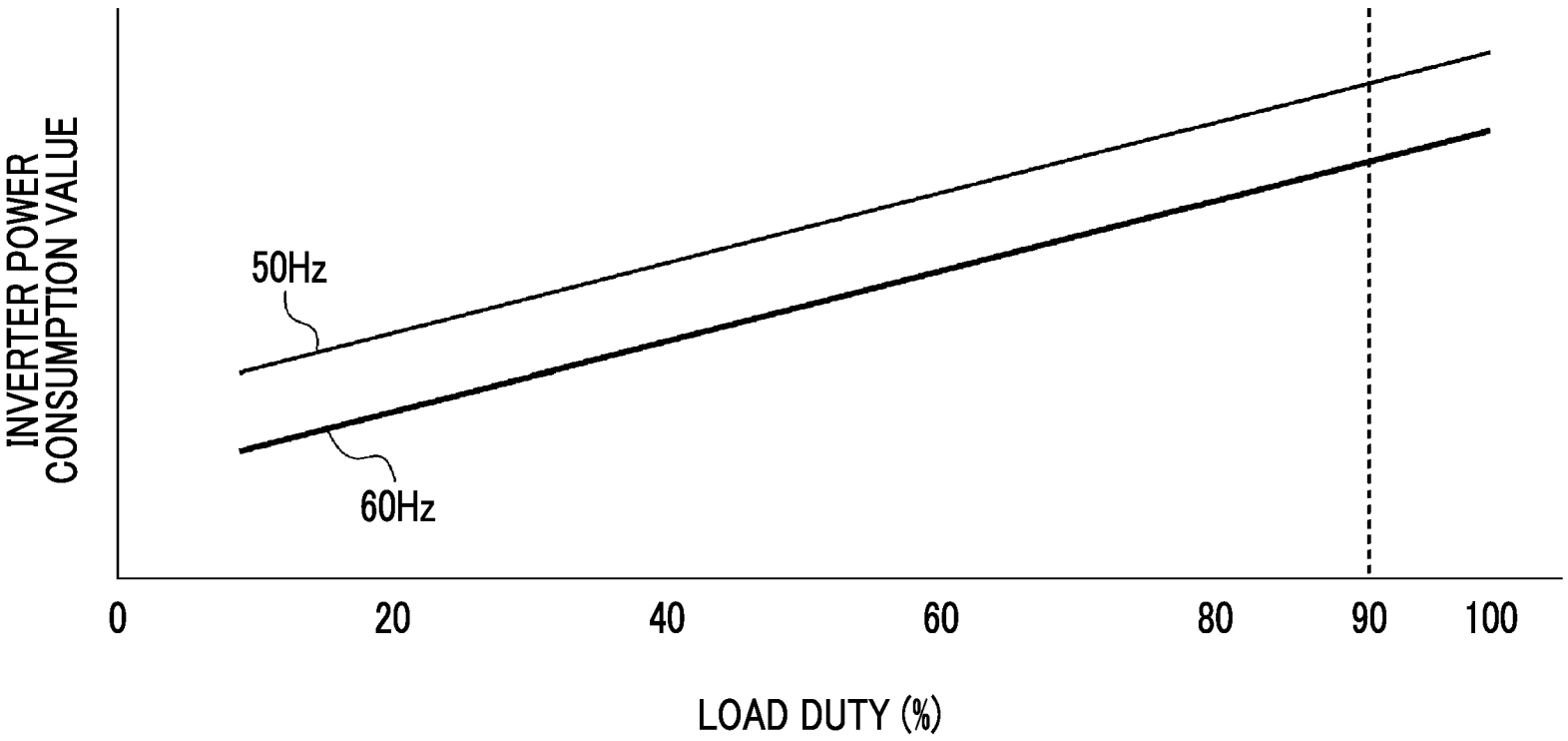
FIG. 8 is a graph showing a relationship between power consumption of an inverter and a load duty for a plurality of operation frequency values.

FIG. 8 is a graph showing a relationship between power consumption of the inverter 90 and a load duty for a plurality of values of operation frequencies. This graph is based on the measurement results by the present inventor. A vertical axis shows a value of the power consumption of the inverter 90. A horizontal axis shows a load duty of the expander motor 42 in the same manner as in FIG. 3.

As can be understood from FIG. 8, a power consumption value tends to increase as a load duty increases. Therefore, for a value of a certain operation frequency (for example, 60 Hz), the power consumption value when the load duty is smaller than 100% and sufficiently large (for example, 90% to 98%) may be used as a power consumption threshold. When the power consumption of the inverter 90 (or the expander motor 42) exceeds this power consumption threshold, a large load corresponding to the load duty is applied to the expander motor 42. This is regarded as prediction of the occurrence of an abnormal operation of the expander motor 42, and measures such as issuing a warning, lowering an operation frequency, and stopping an operation of the cryocooler 10, can be taken to prevent the occurrence of an abnormal operation.

A power consumption value depends on an operation frequency of the expander motor 42. As shown in FIG. 8, in a case where operation frequencies are 50 Hz and 60 Hz, power consumption values indicating the same load duty are different. Therefore, in the embodiment, the power consumption threshold is set for each of the plurality of values of the operation frequencies of the expander motor 42.

The monitoring of the expander motor 42 based on the power consumption has an advantage that the possibility of erroneous prediction due to the influence of an external magnetic field can be reduced compared with the monitoring based on the motor current described above. As described above, the external magnetic field may increase or decrease a current flowing through the expander motor 42. The external magnetic field may cause a similar increase or decrease in power consumption. However, according to the measurement and study by the present inventor, an amount of change in the power consumption value when the load duty changes by a certain unit amount (for example, 1%) tends to be larger than an amount of change in the motor current when the load duty changes by the unit amount. In other words, the gradient in the graph in FIG. 8 tends to be larger than the gradient in the graph in FIG. 3. Therefore, the change in the apparent load duty corresponding to the change in the power consumption value caused by the external magnetic field with a certain magnitude tends to be smaller than the change in the apparent load duty corresponding to the change in the motor current caused by the external magnetic field with the same magnitude. Therefore, in the monitoring of the expander motor 42 based on the power consumption, the influence of the external magnetic field can be made relatively small.

As shown in FIG. 8, the relationship between the power consumption value and the load duty is closer to linear than the relationship between the motor current value and the load duty shown in FIG. 3. Thus, there is also an advantage that it is easy to monitor an operation status in a region where the load duty is relatively small.

Figure 9:
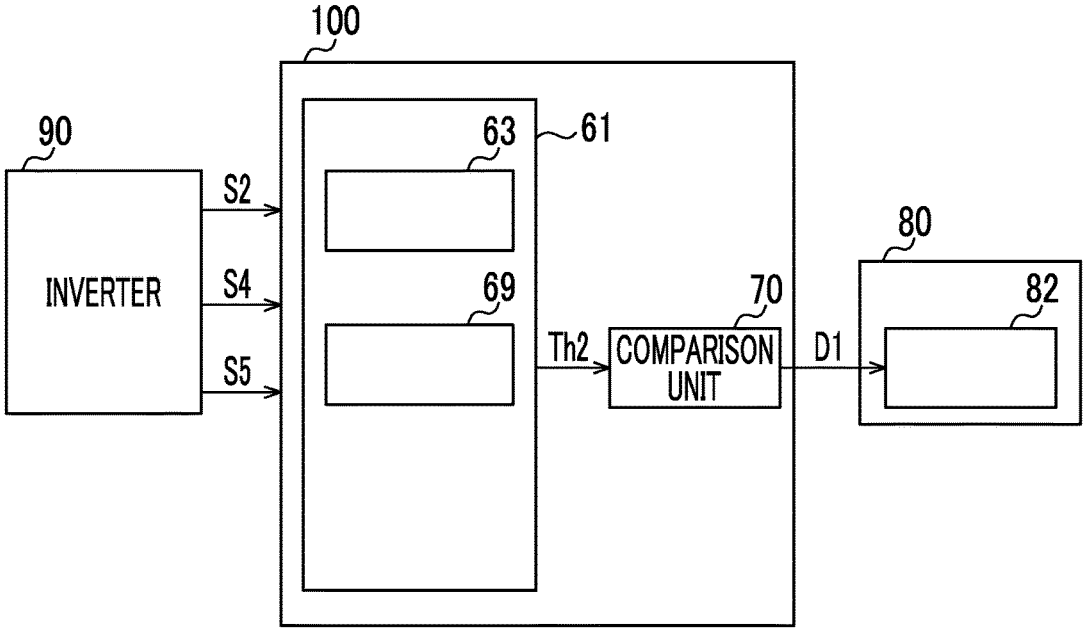
FIG. 9 is a block diagram of a motor monitoring device according to another embodiment.

FIG. 9 is a block diagram of a motor monitoring device according to another embodiment. The monitoring device includes a processor 100 that monitors the expander motor 42 on the basis of a power consumption signal S5 indicating power consumption of the inverter 90. The inverter 90 may be configured to output the power consumption signal S5 indicating the power consumption of the inverter 90 to the processor 100 in addition to the output frequency information S2 and the output voltage signal S4. The processor 100 monitors the expander motor 42 on the basis of the power consumption signal S5 output from the inverter 90. The monitoring device may include the notifier 80 for providing a notification of information indicating a monitoring result, and the notifier 80 may include, for example, the display 82.

The processor 100 acquires power consumption threshold Th2 on the basis of operation conditions of the expander motor 42, and monitors the expander motor 42 by comparing a power consumption value of the inverter 90 with the power consumption threshold Th2 on the basis of the power consumption signal S5.

The processor 100 includes a power consumption threshold setting unit 61 and a comparison unit 70. The power consumption threshold setting unit 61 includes an operation frequency/power consumption threshold table 63 and an output voltage/power consumption threshold table 69. The operation frequency/power consumption threshold table 63 is a table in which a plurality of power consumption thresholds are respectively associated with a plurality of values of operation frequencies of the expander motor 42, and the output voltage/power consumption threshold table 69 is a table in which a plurality of power consumption thresholds are respectively associated with a plurality of values of output voltages from the inverter 90. These power consumption threshold tables are set in advance and stored in the processor 100. These power consumption threshold tables may be set as appropriate on the basis of the empirical knowledge of a designer or experiments or simulations by the designer.

For example, the power consumption threshold setting unit 61 is configured to, on the basis of the operation frequency/power consumption threshold table 63 and a value of an operation frequency of the expander motor 42, acquire the power consumption threshold Th2 corresponding to the value of the operation frequency. The inverter 90 is configured to output the output frequency information S2 indicating a value of an output frequency of the inverter 90 (that is, an operation frequency of the expander motor 42) to the processor 100.

In the operation frequency/power consumption threshold table 63, for each of the plurality of values of the operation frequency of the expander motor 42, when a load torque, by a predetermined amount, smaller than the maximum load torque allowed for the expander motor 42 acts on the expander motor 42 (that is, when a load duty is a predetermined value), a power consumption value of the inverter 90 (or the expander motor 42) under the value of the operation frequency may be associated with the value of the operation frequency as a power consumption threshold. The load duty of a predetermined value may be selected from, for example, a range of 80% or more and less than 100%, or a range of 90% or more and 98% or less.

A plurality of operation frequency/power consumption threshold tables 63 may be set in advance, and the plurality of operation frequency/power consumption threshold tables 63 may be respectively associated with values of a plurality of different load duties. The power consumption threshold setting unit 61 may acquire the power consumption threshold Th2 corresponding to a value of an operation frequency on the basis of the operation frequency/power consumption threshold table 63 selected from among the plurality of operation frequency/power consumption threshold tables 63 and the value of the operation frequency of the expander motor 42.

The power consumption threshold setting unit 61 may be configured to acquire the power consumption threshold Th2 corresponding to a value of an output voltage on the basis of the output voltage/power consumption threshold table 69 and the value of the output voltage from the inverter 90. In addition to the output frequency information S2, the inverter 90 may be configured to output the output voltage signal S4 indicating a value of an output voltage (that is, an input voltage to the expander motor 42) of the inverter 90 to the processor 100.

A plurality of output voltage/power consumption threshold tables 69 may be set in advance, and the plurality of output voltage/power consumption threshold tables 69 may be respectively associated with values of a plurality of different operation frequencies. For example, the first and second output voltage/power consumption threshold tables 69 may be set in advance, and the first output voltage/power consumption threshold table 69 may be used in a case where the expander motor 42 is driven at a value of a first operation frequency (for example, 70 Hz), and the second output voltage/power consumption threshold table 69 may be used in a case where the expander motor 42 is driven at a value of a second operation frequency (for example, 60 Hz) different from the value of the first operation frequency.

The comparison unit 70 compares the power consumption value of the inverter 90 with the acquired power consumption threshold Th2 on the basis of the power consumption signal S5, and generates the monitoring result data D1 on the basis of the comparison result. Similar to the embodiment described with reference to FIG. 5, the monitoring result data D1 is sent to the notifier 80, and a user is notified of the monitoring result, for example, by displaying the monitoring result on the display 82.

The processor 100 may perform monitoring of the expander motor 42 based on such power consumption in at least a steady operation of the cryocooler 10. Similar to the embodiment illustrated in FIG. 5, the processor 100 may acquire information indicating a current operation mode of the cryocooler 10 from a controller (for example, the compressor controller 24), or determine the current operation mode on the basis of the measured temperature signal S3 from the temperature sensor 52. The processor 100 may monitor the expander motor 42 on the basis of the power consumption signal S5 in a case where the current operation mode is a steady operation. In addition to or instead of this, the processor 100 may monitor the expander motor 42 on the basis of the power consumption signal S5 in a case where the current operation mode is a cool-down operation.

Instead of the power consumption of the inverter 90, the processor 100 may monitor the expander motor 42 on the basis of the power consumption signal S5 indicating the power consumption of the expander motor 42. In this case, the processor 100 may acquire a current and a voltage supplied to the expander motor 42 and calculate the power consumption of the expander motor 42 from the current and the voltage. The processor 100 may acquire a current of the expander motor 42 from the motor current signal S1 input from the current sensor 50. The processor 100 may acquire a voltage of the expander motor 42 from the output voltage signal S4 input from the inverter 90. Alternatively, a voltage sensor that measures a voltage supplied to the expander motor 42 may be provided, and the processor 100 may acquire a voltage of the expander motor 42 from a motor voltage signal input from the voltage sensor. The processor 100 may compare the power consumption of the expander motor 42 with the acquired power consumption threshold Th2 on the basis of the power consumption signal S5, and generate the monitoring result data D1 on the basis of the comparison result.

Figure 10:
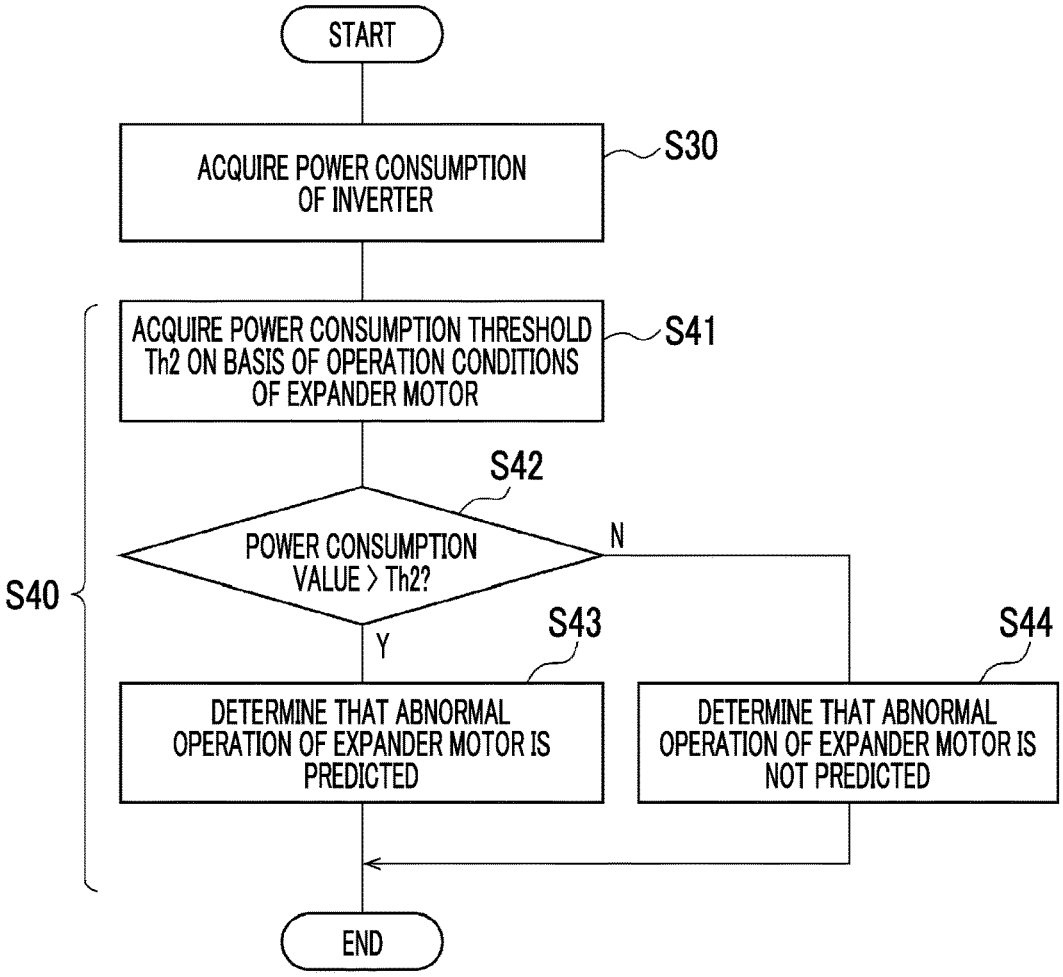
FIG. 10 is a flowchart showing a monitoring method for a cryocooler according to another embodiment.

FIG. 10 is a flowchart showing a monitoring method for the cryocooler 10 according to another embodiment. First, as shown in FIG. 10, power consumption of the inverter 90 (or the expander motor 42) is acquired during an operation (for example, during a steady operation) of the cryocooler 10 (S30). The expander motor 42 is monitored on the basis of the acquired power consumption (S40).

In S40, the power consumption threshold Th2 is acquired on the basis of operation conditions of the expander motor 42 (for example, the output frequency information S2 and the output voltage signal S4) (S41). The value of the acquired power consumption of the inverter 90 is compared with the power consumption threshold Th2 (S42). In a case where the power consumption value exceeds the power consumption threshold Th2 (Y in S42), the comparison unit 70 determines that the occurrence of an abnormal operation of the expander motor 42 is predicted (S43), and outputs the monitoring result data D1 indicating the fact. In a case where the power consumption value is equal to or less than the power consumption threshold Th2 (N in S42), the comparison unit 70 determines that the occurrence of an abnormal operation of the expander motor 42 is not predicted (S44), and outputs the monitoring result data D1 indicating the fact. As described above, the present monitoring method is ended.

In a case where the occurrence of an abnormal operation of the expander motor 42 is predicted, a controller (for example, the compressor controller 24) of the cryocooler 10 may take measures such as issuing a warning, lowering an operation frequency of the expander motor 42, and stopping an operation of the cryocooler 10, to prevent the occurrence of an abnormal operation.

As described above, according to the embodiment, by monitoring the expander motor 42 on the basis of the power consumption of the inverter 90 (or the expander motor 42), it is possible to predict or prevent an abnormal operation or a failure of the expander motor 42 due to long-term operation.

The present invention has been described on the basis of the embodiments. It is clear for those skilled in the art that the present invention is not limited to the embodiments, various design changes can be made, various modification examples can be made, and such modification examples are also within the scope of the present invention. The various features described in relation to a certain embodiment are also applicable to other embodiments. New embodiments resulting from a combination have the effects of each of combined embodiments.

In the above-described embodiment, in order for the processor 100 to acquire a current threshold on the basis of the operation conditions of the expander motor 42, the processor 100 includes three current threshold tables such as the operation frequency/current threshold table 62 the external magnetic field/current threshold table 64, and the input voltage/current threshold table 66. However, these three tables are not essential. For example, the processor 100 may include only the operation frequency/current threshold table 62.

Alternatively, the processor 100 does not need to include the operation frequency/current threshold table 62. In this case, the processor 100 may include either or both of the external magnetic field/current threshold table 64 and the input voltage/current threshold table 66, and the external magnetic field/current threshold table 64 (or the input voltage/current threshold table 66) may be set in advance to be used at a specific operation frequency for monitoring. In this case, the processor 100 may determine whether or not the expander motor 42 is operating at a specific operation frequency for monitoring on the basis of the output frequency information S2, and may monitor the expander motor 42 by comparing a current of the expander motor 42 with the current threshold on the basis of the motor current signal S1 obtained during the operation of the expander motor 42 at the specific operation frequency.

The processor 100 may operate the inverter 90 to drive the expander motor 42 at a monitoring operation frequency, and monitor the expander motor 42 by comparing a current of the expander motor 42 with a current threshold on the basis of the motor current signal S1 when the expander motor 42 is driven at the monitoring operation frequency. As described above, a fixed current threshold corresponding to the monitoring operation frequency may be used for comparison between the current of the expander motor 42 and the current threshold. Even in this case, the current threshold may be adjusted on the basis of motor operation conditions such as an external magnetic field.

In a certain embodiment, the cryocooler 10 may be a single-stage GM cryocooler or another type of cryocooler that includes the expander motor 42 for operating the expander 14.

In a certain embodiment, the processor 100 may be a part of a cryogenic system (for example, a superconducting apparatus or an MRI system) provided with the cryocooler 10 instead of forming a part of the cryocooler 10.

The present invention has been described by using specific terms and phrases on the basis of the embodiments, but the embodiments show only one aspect of the principles and applications of the present invention, and various modifications and disposition changes are permitted in the embodiments within the scope without departing from the concept of the present invention defined in the claims.

The present invention can be used in the field of a cryocooler and a monitoring method for the cryocooler.

It should be understood that the invention is not limited to the above-described embodiment, but may be modified into various forms on the basis of the spirit of the invention. Additionally, the modifications are included in the scope of the invention.

What is claimed is:

1. A cryocooler comprising:

an expander motor that operates an expander of the cryocooler;

an inverter that is configured to control an operation frequency of the expander motor; and a processor that monitors the expander motor on a basis of a power consumption signal indicating power consumption of the inverter or the expander motor, wherein:

the processor comprises an operation frequency/power consumption threshold table in which a plurality of power consumption thresholds are respectively associated with a plurality of values of operation frequency of the expander motor, the processor is configured to:

acquire, on a basis of the operation frequency/power consumption threshold table and a value of the plurality of values of operation frequency of the expander motor, a certain power consumption threshold associated with the value of the operation frequency, and monitor the expander motor by comparing the power consumption of the inverter or the expander motor with the certain power consumption threshold on the basis of the power consumption signal.

2. The cryocooler according to claim 1, wherein the processor monitors the expander motor on the basis of the power consumption signal that output from the inverter and indicating the power consumption of the inverter.

3. The cryocooler according to claim 2, wherein the processor is configured to:

acquire a power consumption threshold on a basis of an operation condition of the expander motor, and monitor the expander motor by comparing the power consumption of the inverter with the power consumption threshold on the basis of the power consumption signal.

4. The cryocooler according to claim 2, wherein the processor comprises an output voltage/power consumption threshold table in which a plurality of power consumption thresholds are respectively associated with a plurality of values of output voltage from the inverter, the processor is configured to:

acquire, on a basis of the output voltage/power consumption threshold table and a value of the output voltage from the inverter, a certain power consumption threshold associated with the value of the output voltage, and monitor the expander motor by comparing the power consumption of the inverter with the certain power consumption threshold on the basis of the power consumption signal.

5. A monitoring method for a cryocooler, in which the cryocooler includes an expander motor that operates an expander of the cryocooler, and an an inverter that is configured to control an operation frequency of the expander motor and a processor comprising an operation frequency/power consumption threshold table in which a plurality of power consumption thresholds are respectively associated with a plurality of values of operation frequency of the expander motor, the monitoring method comprising:

acquiring power consumption of the inverter or the expander motor;

acquiring on a basis of the operation frequency/power consumption threshold table and a value of the plurality of values of operation frequency of the expander motor, a certain power consumption threshold associated with the value of the operation frequency; and monitoring the expander motor by comparing the power consumption of the inverter or the expander motor with the certain power consumption threshold on a basis of the acquired power consumption.

6. The cryocooler according to claim 1, wherein the processor is configured to continue a steady operation of the cryocooler when the power consumption of the inverter or the expander motor is equal to or less than the certain power consumption threshold.

7. The cryocooler according to claim 1, wherein the processor is configured to lower the operation frequency of the expander motor or stop an operation of the cryocooler when the power consumption of the inverter or the expander motor exceeds the certain power consumption threshold.

* * * * *